US011056259B2

(12) United States Patent
Xin et al.

(10) Patent No.: US 11,056,259 B2
(45) Date of Patent: Jul. 6, 2021

(54) MAGNETIC COMPONENT

(71) Applicant: Delta Electronics (Shanghai) CO., LTD, Shanghai (CN)

(72) Inventors: Zhangnan Xin, Shanghai (CN); Jinping Zhou, Shanghai (CN); Liangde He, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 386 days.

(21) Appl. No.: 15/966,241

(22) Filed: Apr. 30, 2018

(65) Prior Publication Data

US 2018/0336986 A1 Nov. 22, 2018

(30) Foreign Application Priority Data

May 16, 2017 (CN) ..... 201710343404.4

(51) Int. Cl.

| | |
|---|---|
| ***H01F 3/14*** | (2006.01) |
| ***H01F 19/00*** | (2006.01) |
| ***H01F 17/04*** | (2006.01) |
| ***H01F 5/00*** | (2006.01) |
| ***H01F 27/28*** | (2006.01) |
| ***H01F 17/06*** | (2006.01) |

(52) U.S. Cl.

CPC ..... *H01F 3/14* (2013.01); *H01F 5/00* (2013.01); *H01F 17/04* (2013.01); *H01F 17/06* (2013.01); *H01F 19/00* (2013.01); *H01F 27/2852* (2013.01)

(58) Field of Classification Search

CPC ..... H01F 3/14; H01F 27/2852; H01F 17/06; H01F 19/00; H01F 17/04; H01F 5/00; H01F 17/045; H01F 27/24; H01F 27/292; H01F 27/306

See application file for complete search history.

(56) References Cited

U.S. PATENT DOCUMENTS 5,210,514 A * 5/1993 Ito ..... H01F 3/14 336/178
6,356,179 B1 * 3/2002 Yamada ..... H01F 17/04 336/175

FOREIGN PATENT DOCUMENTS

| | | | |
|---|---|---|---|
| CN | 204010998 | | 12/2014 |
| CN | 105810406 | A | 7/2016 |
| JP | H02290005 | A | 11/1990 |
| JP | H04142013 | A | 5/1992 |
| JP | 2699020 | B2 | 1/1998 |
| JP | 2010027946 | A | 2/2010 |

OTHER PUBLICATIONS

The CN1OA dated Apr. 3, 2020 by the CNIPA.

* cited by examiner

*Primary Examiner* — Tuyen T Nguyen
(74) *Attorney, Agent, or Firm* — Qinghong Xu

(57) ABSTRACT

There is disclosed a magnetic component which includes a first magnetic pole extending in a first direction and having an air gap provided therein, a second magnetic pole extending in the first direction, a cover plate extending in a second direction perpendicular to the first direction and connected with an end of the first magnetic pole and an end of the second magnetic pole, a protrusion formed on and at least partially surrounding the first magnetic pole, and a winding wound around the first magnetic pole at the air gap and having a lead supported by the protrusions such that a clearance is formed between the winding and the first magnetic pole.

22 Claims, 32 Drawing Sheets

MAGNETIC COMPONENT

CROSS REFERENCE

The present application claims the priority of Chinese Patent Application No. 201710343404.4, filed on May 16, 2017, and the entire contents thereof are incorporated herein by reference as part of the present application.

TECHNICAL FIELD

The present disclosure relates to a magnetic component, in particular to a magnetic component having reduced winding loss and improved circuit efficiency.

BACKGROUND

In recent years, with development of the data center and artificial intelligence and the like, central processing units (CPUs), graphic processing units (GPUs) and various integrated chips (ICs) have an increasing operation speed and an increasing operation current. The requirements on power density, efficiency and dynamic performance and the like of the voltage regulator modules (VRMs) are increasingly higher, and the design of VRMs is facing a challenge. In the VRMs there is usually a relatively high loss in the output inductor, and moreover the magnetic leakage flux of inductor may induce additional the winding loss of the inductor and interfere performance of other elements and devices.

It should be noted that, information disclosed in the above background portion is provided only for better understanding of the background of the present disclosure, and thus it may contain information that does not form the prior art known by those ordinary skilled in the art.

SUMMARY

In aspects of the disclosure there is provided a magnetic component.

According to one aspect of the disclosure, a magnetic component includes:

a first magnetic pole extending in a first direction and having an air gap provided therein;

a second magnetic pole extending in the first direction;

a cover plate extending in a second direction perpendicular to the first direction and connected with an end of the first magnetic pole and an end of the second magnetic pole;

a protrusion formed on and at least partially surrounding the first magnetic pole; and a winding surrounding the first magnetic pole at the air gap and having a lead supported by the protrusion such that a clearance is formed between the winding and the first magnetic pole.

It is to be understood that both the foregoing general description and the following detailed description are exemplary and explanatory only and are not restrictive of the invention, as claimed.

This section provides a summary of various implementations or examples of the technology described in the disclosure, and is not a comprehensive disclosure of the full scope or all features of the disclosed technology.

BRIEF DESCRIPTION OF THE DRAWINGS

The accompanying drawings are provided for further understanding of the disclosure, constitute part of the specification, and serve to explain the disclosure in conjunction with the following particular embodiments, but do not limit the disclosure, in which.

DETAILED DESCRIPTION

In order for those skilled in the art to understand the technical solution of the disclosure, now further detailed description will be made to the magnetic component according to the disclosure in conjunction with the accompanying drawings and the embodiments.

Figure 1A:
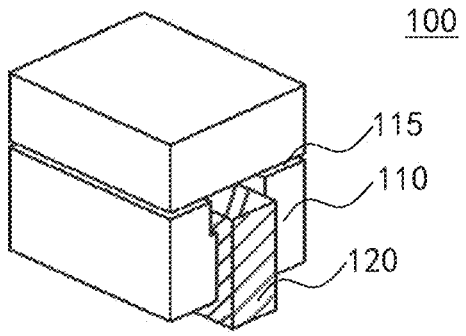
FIGS. 1A-1D are schematic views of a magnetic component according to a comparison example.
Figure 1B:
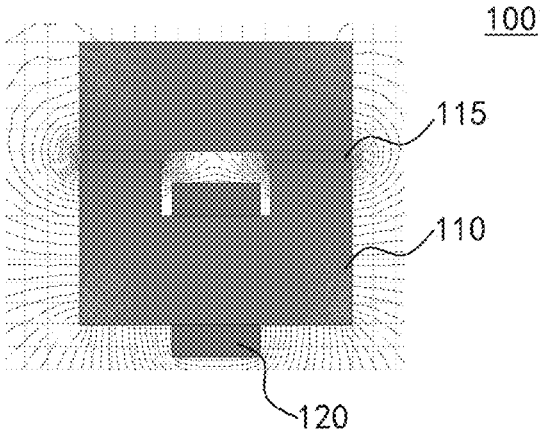
Figure 1C:
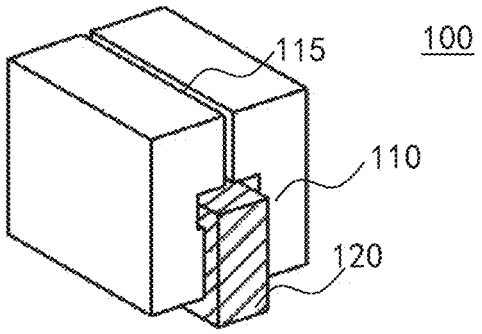
Figure 1D:
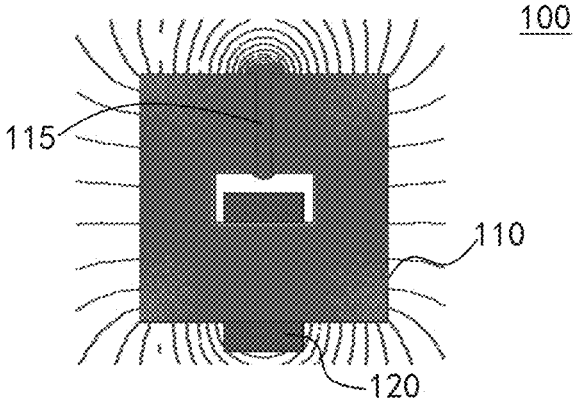

FIGS. 1A-1D are schematic views of a magnetic component according to a comparison example. Referring to FIGS. 1A-1D, the magnetic component according to the comparison example is formed as an inductor 100. Here, FIGS. 1A and 1B show a perspective view and a sectional view of a structure of the inductor 100, respectively; FIGS. 1C and 1D show a perspective view and a sectional view of another structure of the inductor 100, respectively. According to the comparison example, the inductor 100 includes a magnetic core 110 having an air gap 115 therein and a winding 120 wound around the magnetic core 110 and spaced by a distance from the air gap 115.

According to the comparison example, the winding 120 and the air gap 115 are separated from each other, and accordingly the loss of the winding 120 of the inductor 100 can be reduced, thereby facilitating improvement of the circuit efficiency.

However, as shown in FIGS. 1B and 1D, there is an occurrence of fringe magnetic flux expanding outside around the air gap 115 of the inductor 100, which may thus result in other problems, for example may cause additional eddy-current loss in the devices in the vicinity of the inductor, or may cause the inductance value to be susceptible to the peripheral devices such as a heat sink above the inductor.

Figure 2A:
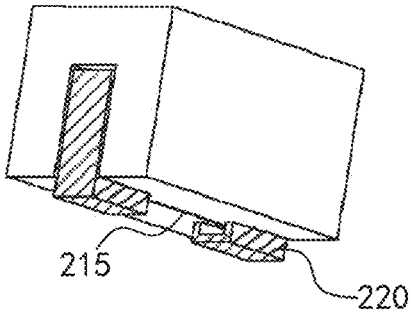
FIGS. 2A-2C are schematic views of a magnetic component according to a comparison example.
Figure 2B:
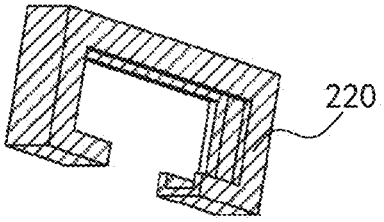
Figure 2C:
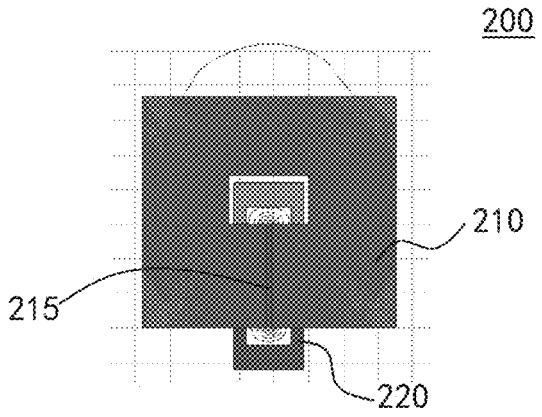

FIGS. 2A-2C are schematic views of a magnetic component according to a comparison example. Referring to FIGS. 2A-2C, the magnetic component according to the comparison example is formed as an inductor 200 which includes a magnetic core 210 having an air gap 215 therein and a winding 220 wound around the magnetic core 210 and covering at least part of the air gap 215, wherein the winding 220 is formed with a groove at a side thereof facing the air gap 215.

According to the comparison example, the formation of the groove avoids a direct contact between the winding 220 and the air gap 215, such that they are separated from each other, accordingly the loss of the winding 220 of the inductor 200 can be reduced, thereby facilitating improvement of the circuit efficiency. Further, since the winding 220 covers at least part of the air gap 215, the fringe magnetic flux can be reduced. However, it is difficult to form a groove in the winding 220, resulting in a complicated production process for the inductor 200, and it is difficult to make a massive production and the cost is high.

Figure 3A:
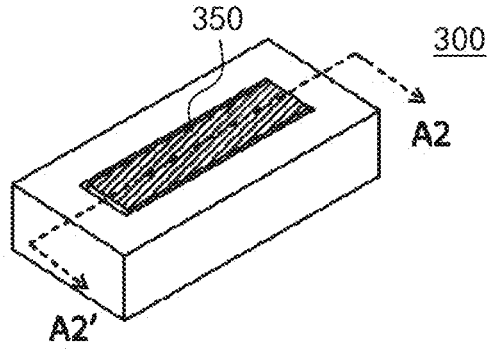
FIGS. 3A-3I are schematic views of a magnetic component according to a first embodiment of the disclosure.
Figure 3B:
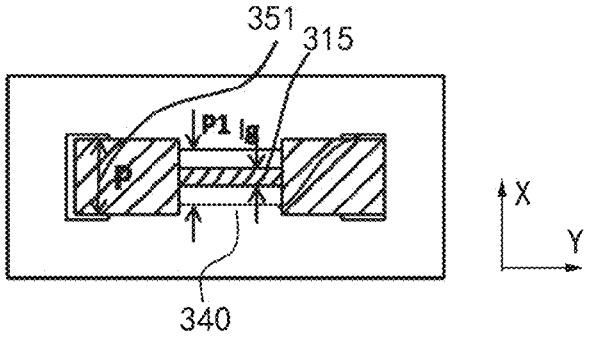
Figure 3C:
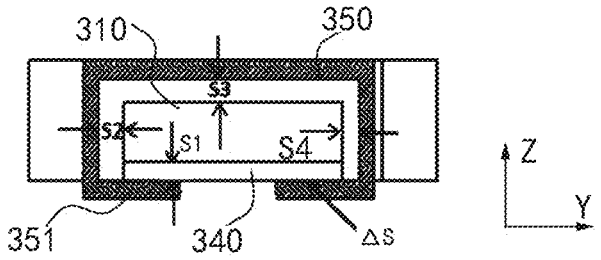
Figure 3D:
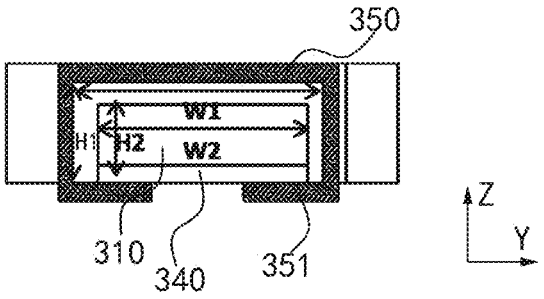
Figure 3E:
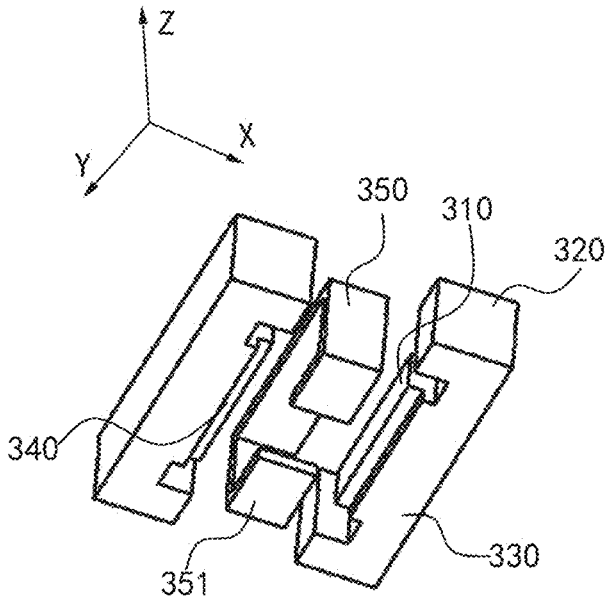
Figure 3F:
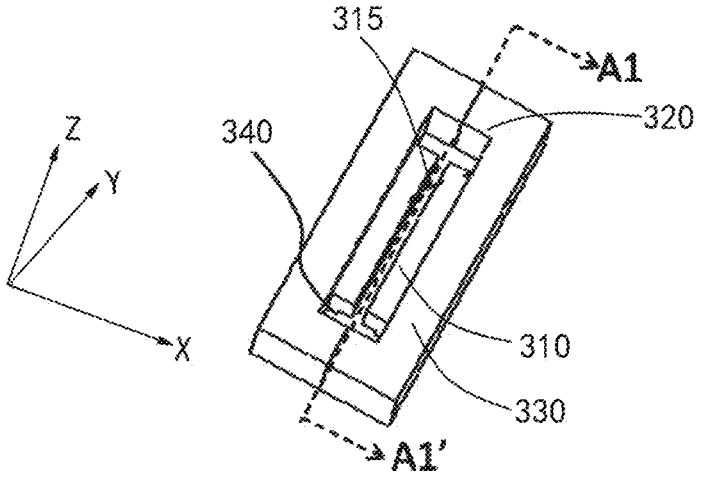
Figure 3G:
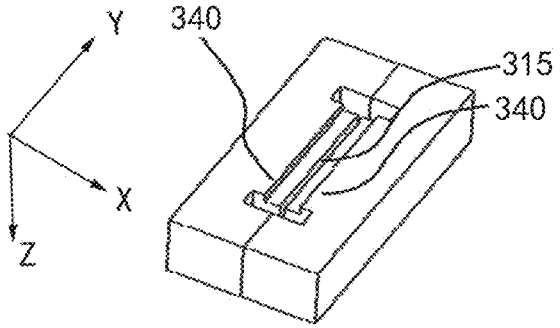
Figure 3H:
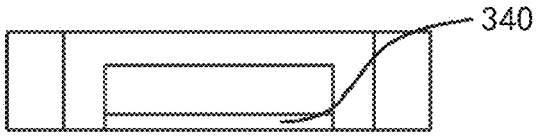
Figure 3I:
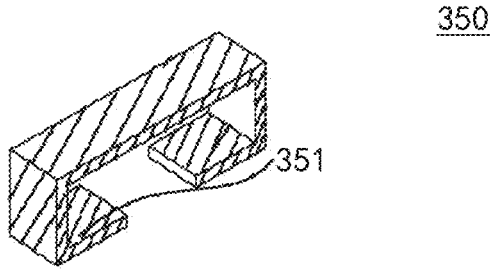

FIGS. 3A-3I are schematic views of a magnetic component and its magnetic core and winding according to a first embodiment of the disclosure. FIG. 3A shows a perspective view of the magnetic component according to the first embodiment of the disclosure, FIG. 3B shows a bottom view of the magnetic component according to the first embodiment of the disclosure, FIG. 3C and FIG. 3D shows a sectional view of the magnetic component according to the first embodiment of the disclosure taken along the line A2-A2', and FIG. 3E shows an exploded perspective view of the magnetic component according to the first embodiment of the disclosure. The magnetic component includes a magnetic core and a winding. FIG. 3F shows a perspective view of the magnetic core of the magnetic component according to the first embodiment of the disclosure, FIG. 3G shows a bottom view of the magnetic core of the magnetic component according to the first embodiment of the disclosure, FIG. 3H shows a sectional view of the magnetic core of the magnetic component according to the first embodiment of the disclosure taken along the line A1-A1', and FIG. 3I shows a perspective view of the winding of the magnetic component according to the first embodiment of the disclosure.

Referring to FIGS. 3A-3I, the magnetic component 300 according to the first embodiment of the disclosure includes:

a first magnetic pole 310 extending in a first direction, such as the x direction, and having an air gap 315 provided therein;

a second magnetic pole 320 extending in the first direction;

a cover plate 330 extending in a second direction, such as the y direction, perpendicular to the first direction and connected with an end of the first magnetic pole 310 and an end of the second magnetic pole 320;

a protrusion formed on and at least partially surrounding the first magnetic pole 310; and a winding 350 surrounding the first magnetic pole 310 at the air gap 315 and having a lead 351 supported by the protrusion 350 such that a clearance is formed between the winding 350 and the first magnetic pole 310 in a third direction.

According to the embodiment, the first magnetic pole 310 extending in the x direction may indicate that the connection line between a first and a second ends of the first magnetic pole 310 is in the x direction, wherein the first and second ends of the first magnetic pole 310 are connected to the cover plate 330, respectively.

The protrusion 340 is formed to at least partially surround the first magnetic pole 310 such that a portion of the first magnetic pole 310 contacts the protrusion 340 while another portion of the first magnetic pole 310 may not contact the protrusion 340.

In an embodiment, as shown in FIG. 3B, in the first direction such as the x direction, the lead 351 has a total width represented by P. The portion of the lead 351 not contacting the protrusion 340 has a width, represent by P1, in the first direction. The air gap 315 has a width, represented by Ig, in the first direction.

According to an embodiment of the disclosure, the total width P of the lead 351 in the first direction and the width P1 of the portion of the lead 351 not contacting the protrusion 340 satisfy the following relationship: $P1 \geq P/3$.

In an embodiment, as shown in FIG. 3C, in the third direction such as the z direction perpendicular to the plane formed by the x and y directions, a distance between the lead 351 and the air gap 315 is represented by S1, and a distance between the winding 350 and the air gap 315 is represented by S3; in the second direction such as the y direction, distances between the winding 350 and the air gap 315 are represented by S2 and S4, respectively. In addition, as shown in FIG. 3C, due to limitation of production process, there may be a clearance $\Delta S$ between the winding 350 and the protrusion 340 which may be caused by manufacturing tolerance. The disclosure, however, is not limited thereto.

In an embodiment, at least one of the distance S2 or S4 between the winding 350 and the air gap 315 in the second direction and the distance S3 between the winding 350 and the air gap 315 in the third direction is greater than 0. In another embodiment, at least one of the aforesaid distances S2, S3 or S4 is equal to or greater than P/6.

In another embodiment, referring to FIG. 3D, in the second direction such as the y direction, a length of the two opposing inner walls of the winding 350 is represented by W1, and a length of the first magnetic pole 310 is represented by W2: in the third direction such as the z direction, a height of the two opposing inner walls of the winding 350 is represented by H1, and a height of the first magnetic pole 310 in the third direction is represented by H2. In the embodiment as shown in FIG. 3D, the length W1 of the winding 350 may be greater than the length W2 of the first magnetic pole 310. In addition, the height H1 of the winding 350 may be greater than the height H2 of the first magnetic pole 310. In an embodiment, the winding 350 has stiffness sufficient to maintain its shape such that clearances can be naturally kept between the winding 350 and the first magnetic pole 310 in each of the area of the lead 351 for conducting AC directions, thereby having advantages of such as high usage of the magnetic core, low magnetic leakage flux, low loss and easy production.

According to an embodiment of the disclosure, the distance S1 between the lead 351 and the air gap 315 in the third direction and the width P1 of the portion of the lead not contacting the protrusion satisfy the following relationship: $S1 \geq P1/6$.

Referring to FIG. 3E, according to the first embodiment of the disclosure, the magnetic component 300 has two protrusions 340 arranged at each side of the air gap 315 in the first magnetic pole 310, respectively. In the embodiment, the protrusions 340 and the leads 351 are both positioned below the first magnetic pole 310, for example, in the downward direction of the z direction, such that both the protrusions 340 and the leads 351 are provided at the same side of the magnetic component 300. With such a structure, after the magnetic component is assembled, the protrusions 340 support the leads 351 of the winding 350 such that a clearance is formed in the third direction between the winding 350 and the air gap 315.

According to the embodiment, the magnetic component includes a first magnetic pole extending in a first direction and having an air gap provided therein, a second magnetic pole extending in the first direction, a cover plate extending in a second direction perpendicular to the first direction and connected with an end of the first magnetic pole and an end of the second magnetic pole, a protrusion formed on and at least partially surrounding the first magnetic pole, and a winding wound around the first magnetic pole at the air gap and having a lead supported by the protrusions such that a clearance is formed between the winding and the first magnetic pole. Accordingly, the magnetic component has at least one of following advantages: firstly, the magnetic core has a high utilization, the windings may be easily separated from the air gap, the winding may be directly assembled with the magnetic core after being formed, the assembly is easy and the cost is low; secondly, the air gap has its circumference surrounded by the winding, the fringe magnetic flux is small and mutual interference with peripheral devices is low; thirdly, the winding has a simple structure and may be fabricated easily; fourthly, selection of the lead structure of the winding and the magnetic core structure is flexible, and the interconnection with the power modules is convenient; and fifthly, the eddy-current loss of the winding is reduced, and the AC resistance is decreased, thereby facilitating improvement of the circuit efficiency.

Figure 4A:
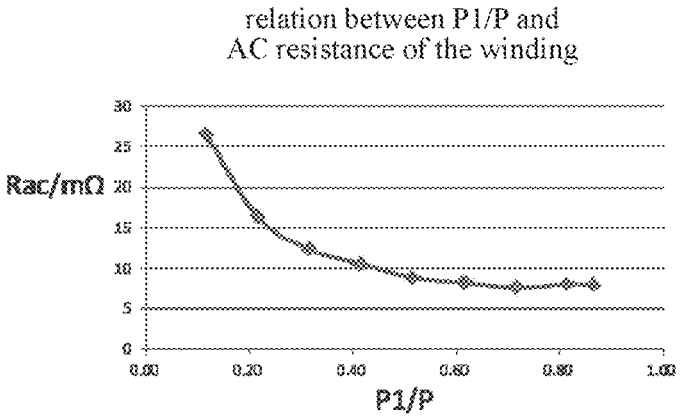
FIGS. 4A and 4B are graphs showing AC resistance variance according to the disclosure.
Figure 4B:
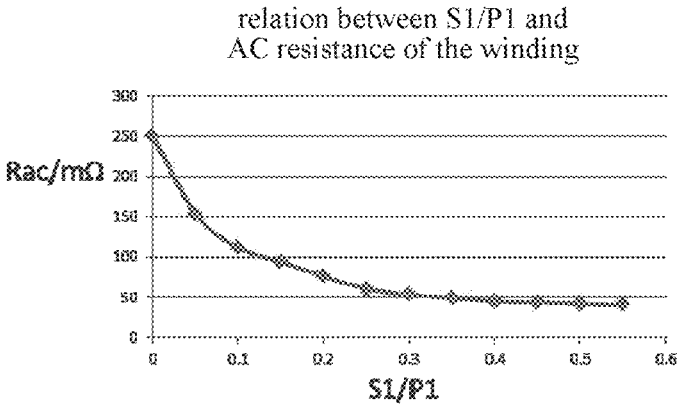

FIGS. 4A and 4B are graphs showing AC resistance variance according to the disclosure. The AC resistance variance with the structure of the magnetic component according to the disclosure will be explained in detail with reference to FIGS. 4A and 4B.

As shown in FIG. 4A, the AC resistance Rac of the winding decreases gradually as the P1/P gradually increasing. In other words, with increase of the ratio of the width P1 of the portion of the lead 351 not contacting the protrusion 340 in the first direction to the total width P of the lead 351 in the first direction, the AC resistance Rac of the winding decreases gradually. However, an overlarge ratio of P1/P is not in favor for supporting the winding 350 by the protrusion 340, i.e., may result in that the protrusion 340 could not work to support the winding 350. Accordingly, according to an embodiment of the disclosure, the total width P of the lead 351 in the first direction, i.e., the total width of the winding 350, and the width P1 of the portion of the lead 351 not contacting the protrusion 340 in the first direction satisfy the following relationship: $P1 \geq P/3$. Therefore, the cross-sectional area of the lead 351 for conducting AC current can be increased, which results in lower AC copper loss, and meanwhile the supporting effect of the protrusion 340 can be assured.

As shown in FIG. 4B, the AC resistance Rac of the winding decreases gradually as the S1/P1 gradually increasing. In other words, with increase of the ratio of the distance S1 between the lead 351 and the air gap 315 to the width P1 of the portion of the lead 351 not contacting the protrusion 340 in the first direction, the AC resistance Rac of the winding decreases gradually. However, an overlarge ratio of S1/P1 is not in favor for compactness of the magnetic component, thereby reducing the space utilization of a device including the magnetic component. Accordingly, according to an embodiment of the disclosure, the distance S1 between the lead 351 and the air gap 315 in the third direction and the width P1 of the portion of the lead 351 not contacting the protrusion 340 in the first direction satisfy the following relationship: $S1 \geq P1/6$. Accordingly, on one hand, the distance S1 between the lead 351 and the air gap 315 can be optimized, facilitating uniform distribution of the AC current one the lead 351, on the other hand, the distance S1 will not be overlarge, and in turn both the AC resistance of the winding 350 and the volume of the magnetic component can be as small as possible. Further, the disclosure is not limited thereto. Similar to the distance S1 between the lead 351 and the air gap 315 in the third direction, the relationships between distances between the winding and the lead in other directions, for example, the aforesaid distances S2, S3 and S4, and the width P of the winding also satisfy the relationship of being equal to or greater than P/6.

Figure 5:
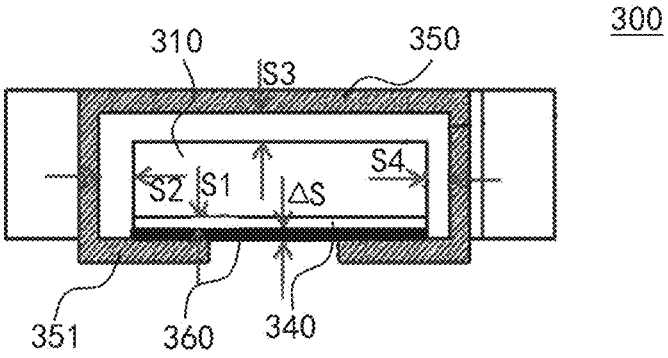
FIG. 5 is a schematic view of a magnetic component according to a second embodiment of the disclosure.

FIG. 5 is a schematic view of a magnetic component according to a second embodiment of the disclosure. Referring to FIG. 5, the magnetic component 300 according to the second embodiment of the disclosure includes similar structure to the magnetic component 300 according the first embodiment of the disclosure, except the non-magnetic material 360.

In particular, as shown in FIG. 5, according to the second embodiment, there may be also non-magnetic material 360 between the protrusion 340 and the lead 351. For example, the non-magnetic material 360 may be adhesive or other non-magnetic material. With the formation of the non-magnetic material 360, the distance between the protrusion 340 and the lead 351 may be increased, thereby facilitating decreasing the AC loss.

In an embodiment, the protrusion 340 may be made from the same material from which the first magnetic pole, the second magnetic pole and/or the cover plate of the magnetic core are made. In the case, the protrusion 340 may be integrally formed with the first magnetic pole 310, thereby simplifying the production process and reducing the production cost.

In addition, in another embodiment, the protrusion 340 may also be made from non-magnetic material, thereby facilitating increase of cross-sectional area of the lead through which an AC current flows, and thus reducing the AC loss. In the embodiment, when the protrusion 340 is made from non-magnetic material, the additional non-magnetic material 360 may be omitted.

Figure 6A:
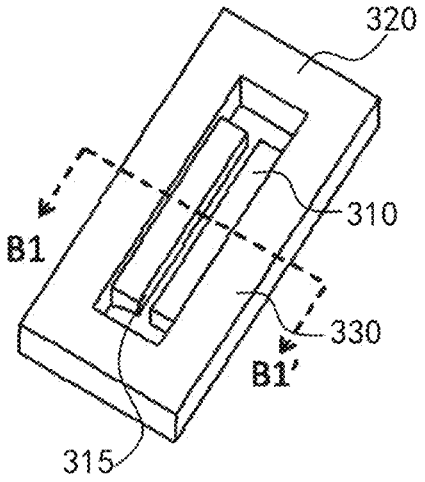
FIGS. 6A-6C are schematic views of a magnetic component according to a third embodiment of the disclosure.
Figure 6B:
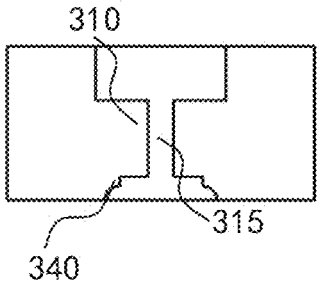
Figure 6C:
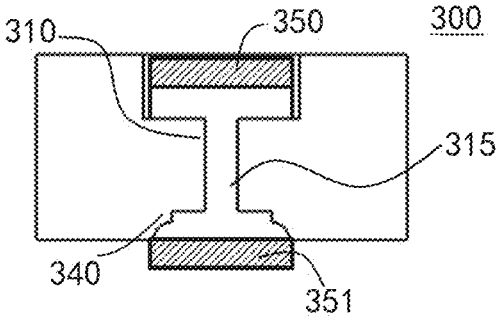

FIGS. 6A and 6B are schematic views of a magnetic component according to a third embodiment of the disclosure. FIG. 6A is a perspective view of a magnetic core of the magnetic component according to the third embodiment of the disclosure, FIG. 6B is a sectional view taken along the line B1-B1' in FIG. 6A, and FIG. 6C is a sectional view of the magnetic component 300 according to the third embodiment of the disclosure.

Referring to 6A-6C, the magnetic component 300 according to the third embodiment of the disclosure differs from the magnetic components 300 according to the previous embodiments of the disclosure mainly in that the protrusion 340 has an irregular shape. In particular, a size of the protrusion 340 decreases downwardly. i.e., the protrusion 340 has a shape of becoming smaller in the downward direction. For example, as shown in FIG. 6B, the protrusion 340 is integrally formed with the first magnetic pole 310, and has a sectional area decreases downwardly such that the distance between the two protrusions 340 is increasing along the downward direction. In other words, with being closer to the lead 351 of the winding, the distance between the two protrusions 340 becomes larger.

With the aforesaid structure, the contact area between the protrusion 340 and the lead of the winding can be reduced. Accordingly, if the protrusion is made from magnetic material, the contact area between the magnetic material forming the protrusion 340 and the lead can be reduced. Therefore, the magnetic component according to the embodiment helps to increase the cross-sectional area of the lead 351 through which an AC current flows and reduce the AC loss.

FIGS. 7A-7E are schematic views of a magnetic component according to a fourth embodiment of the disclosure. The magnetic component 300 according to the fourth embodiment of the disclosure differs from the magnetic components 300 according to the previous embodiments of the disclosure mainly in that in the magnetic component 300 according to the fourth embodiment of the disclosure, the two leads 351 of the winding 350 are arranged below the first magnetic pole 310 and the second magnetic pole 320, respectively.

Figure 7A:
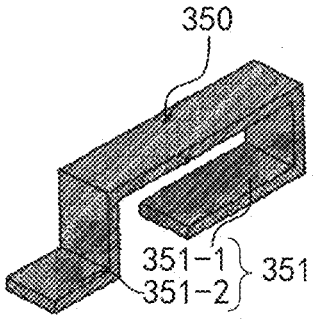
FIGS. 7A-7E are schematic views of a magnetic component according to a fourth embodiment of the disclosure.

As shown in FIG. 7A which shows a schematic view of a winding 350 of the magnetic component 300 according to the fourth embodiment of the disclosure, the winding 350 has two leads 351, i.e., the first lead 351-1 and the second lead 351-2. The first lead 351-1 and the second lead 351-2 are bent towards the same direction. Accordingly, when the winding 350 is combined with the magnetic core, the first lead 351-1 is positioned below the first magnetic pole 310 and the second lead 351-2 is positioned below the second magnetic pole 320.

According to the embodiment, the leads of the winding may be bent in a desired direction depending on requirements in an actual circuit such that the leads of the winding of the magnetic component 300 adapts to a circuit module to be connected, thereby the interconnection between the leads and the circuit module may be achieved more easily.

Furthermore, in the embodiment, the bottom surface of the second magnetic pole 320 may be in the same plane as the bottom surfaces of the protrusions 340. In this case, it can be assured that the leads 351 are supported by the protrusions 340 and the second magnetic pole 320, respectively, and positioned in the same plane.

Furthermore, in the embodiment, the first magnetic pole 310 has a section of non-rectangular. In particular, in the section of the first magnetic pole 310 formed in the second and third directions, the height at the central portion is greater than that at two ends. More particularly, for example, the section of the first magnetic pole may have a shape of ellipse, rounded rectangular, chamfered rectangular, rhombus, fusiform, or a combination thereof.

In the embodiment, the respective distances in the second and third directions between the first magnetic pole 310 and the corners of the winding 350 can be increased, such that the current of the winding 350 may be distributed more even at the corners, and thereby further reducing the loss of the winding 350.

Figure 7B:
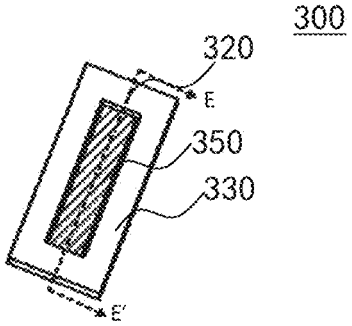
Figure 7C:
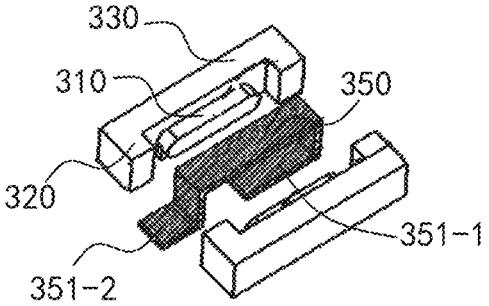
Figure 7D:
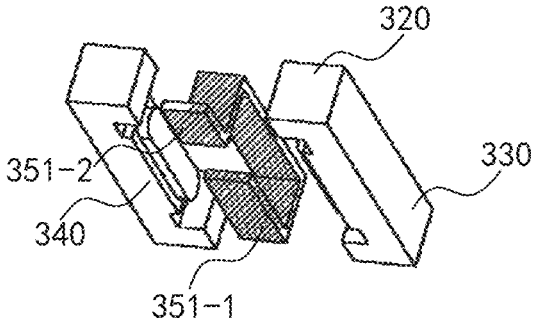
Figure 7E:
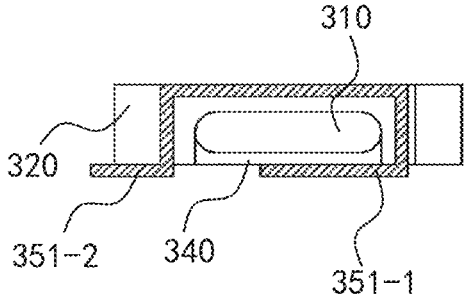

Furthermore, referring to FIG. 7E which shows a section taken along the line E-E' in FIG. 7B, the height of the first magnetic pole 310 in the third direction is less than the height of the second magnetic pole 320 and/or the cover plate in the third direction. In particular, in the third direction, the bottom surface of the first magnetic pole 310 is higher than the bottom surface of the second magnetic pole 320 and/or the cover plate 330. In this case, the bottom surface of the protrusion 340 contacting the bottom surface of the first magnetic pole 310 may be in the same plane as the bottom surface of the second magnetic pole 320 and/or the cover plate 330.

However, the disclosure is not limited thereto. The bottom surface of the protrusion 340 may be higher than that of the second magnetic pole 320 and/or the cover plate 330. In this case, in the embodiment where the leads 351 are both formed to contact the protrusions 340, the total height of the magnetic component can be reduced, thereby helping improve the space utilization.

Furthermore, in another embodiment, the upper surface of the winding 350 may be positioned below, or in the same plane as, the upper surface of the second magnetic pole 320 and/or the cover plate 330. In this case, advantageously, since the upper surface of the winding 350 does not protrude beyond the upper surface of the magnetic core structure, the total height of the magnetic component can be reduced, thereby helping improve the space utilization.

Figure 8:
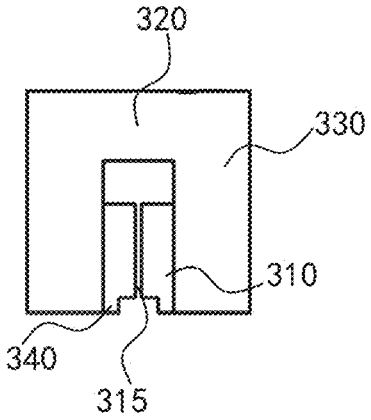
FIG. 8 is a schematic view of a magnetic component according to a fifth embodiment of the disclosure.

Referring to FIG. 8 which is a schematic view of a magnetic component according to a fifth embodiment of the disclosure, only the magnetic core portion of the magnetic component is shown. As shown in FIG. 8, the magnetic component differs from the magnetic components 300 according to other embodiments of the disclosure mainly in that the magnetic component has a magnetic core structure of square shape. Accordingly, the embodiments of the disclosure are not limited only to the magnetic component with "EE"-typed magnetic core as shown in FIGS. 3A-3I, but may be applied to magnetic components with other types of magnetic cores.

Figure 9A:
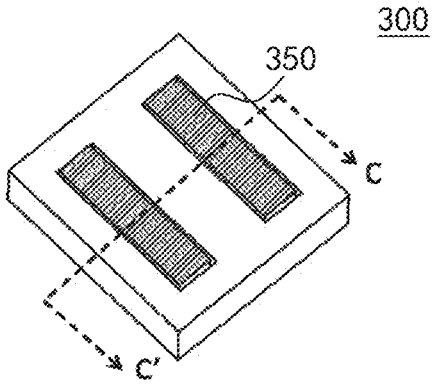
FIGS. 9A and 9B are schematic views of a magnetic component according to a sixth embodiment of the disclosure.
Figure 9B:
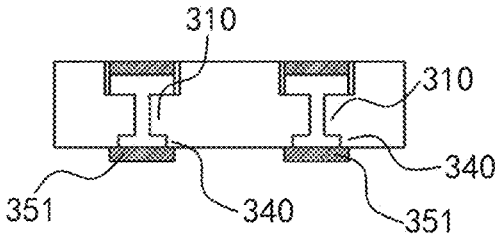

FIGS. 9A and 9B are schematic views of a magnetic component according to a sixth embodiment of the disclosure. FIG. 9A shows a perspective view of the magnetic component 300, and FIG. 9B shows a sectional view taken along the line C-C' in FIG. 9A. As shown in FIGS. 9A and 9B, the magnetic component 300 is formed as a two-phase integrated inductor. As shown in FIGS. 9A and 9B, the magnetic component 300 includes two first magnetic poles 310 and two windings 350 wound around the two first magnetic poles 310, respectively. There are protrusions 340 provided between the two first magnetic poles 310 and the two windings 350, respectively.

In the magnetic component according to the embodiment, for the detailed structures of the first magnetic poles 310, the protrusions 340 and the windings 350, please refer to the aforesaid embodiments of the disclosure, and the description therefor is not repeated here.

According to the embodiment, the magnetic component includes two windings. Accordingly, the magnetic component may be formed as a specific magnetic component such as an integrated inductor or transformer by appropriately setting the coupling schemes. Those skilled in the art would understand how to form those specific magnetic components after fully reading the contents disclosed in the specification, and thus no details are described here.

Figure 10A:
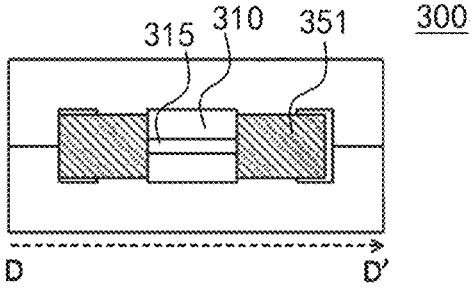
FIGS. 10A and 10B are schematic views of a magnetic component according to a seventh embodiment of the disclosure.
Figure 10B:
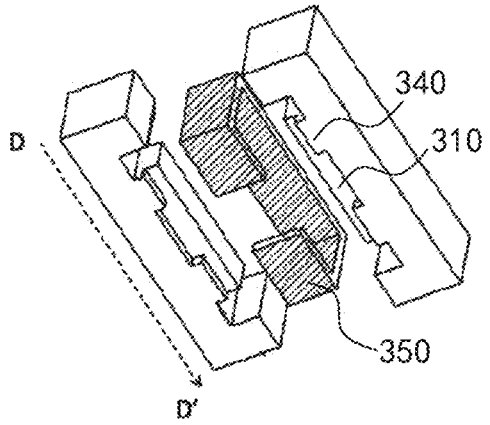

FIGS. 10A and 10B are schematic views of a magnetic component according to a seventh embodiment of the disclosure. FIG. 10A shows a bottom view of the magnetic component 300, and FIG. 10B shows an exploded perspective view of the magnetic component.

As shown in FIGS. 10A and 10B, the protrusion 340 may be discontinuous in the second direction, for example, in the direction shown by the arrow D-D' in FIGS. 10A and 10B. In particular, the protrusion 340 is divided into a plurality of sections each of which is in a position corresponding to the position of a lead 351 of the winding 350. In this case, since there is not a protrusion 340 formed at a position where it is not needed, the volume of the protrusion 340 is reduced under the condition of assuring support of the winding 350 by the protrusion 340, thereby saving material for the protrusion 340.

With the magnetic component according to the disclosure which includes a first magnetic pole extending in a first direction and having an air gap provided therein, a second magnetic pole extending in the first direction, a cover plate extending in a second direction perpendicular to the first direction and connected with an end of the first magnetic pole and an end of the second magnetic pole, a protrusion formed on and at least partially surrounding the first magnetic pole, and a winding wound around the first magnetic pole at the air gap and having a lead supported by the protrusions such that a clearance is formed between the winding and the first magnetic pole, at least one of following advantages may be obtained: firstly, the magnetic core has a high utilization, the windings may be easily separated from the air gap, the assembly is easy and the cost is low; secondly, the air gap has its circumference surrounded by the winding, the fringe magnetic flux is small and mutual interference with peripheral devices is low; thirdly, the winding has a simple structure and may be fabricated easily: fourthly, selection of the lead structure of the winding and the magnetic core structure is flexible, and the interconnection with the power modules is convenient; and fifthly, the eddy-current loss of the winding is reduced, and the AC resistance is decreased, thereby facilitating improvement of the circuit efficiency.

Although above descriptions have been made to the disclosure in conjunction with the particular embodiments and the accompanying drawings, those skilled in the art should understand that the features described with reference to one embodiment are not limited to the embodiment, but may be applied into other embodiments to create other embodiments not shown in the accompanying drawings or not particularly described in the specification.

In sum, the magnetic component according to the disclosure can have at least the following advantages: firstly, the magnetic core has a high utilization, the windings may be easily separated from the air gap, the assembly is easy and the cost is low; secondly, the air gap has its circumference surrounded by the winding, the inductor had small fringe magnetic flux and mutual interference with peripheral devices is low; thirdly, the winding has a simple structure and may be fabricated easily: and fourthly, selection of the lead structure of the winding and the magnetic core structure is flexible, and the interconnection with the power modules is convenient.

It should be appreciated that the aforesaid embodiments are only exemplary embodiments used for illustrating the principle of the disclosure. However, the disclosure is not limited thereto. For those skilled in the art, various modifications and improvements can be made without going beyond the spirit and essence of the disclosure, which modifications and improvements are also considered to be the protection scope of the disclosure.

What is claimed is:

1. A magnetic component comprising:

a first magnetic pole extending in a first direction and having an air gap provided therein;

a second magnetic pole extending in the first direction;

a cover plate extending in a second direction perpendicular to the first direction and connected with an end of the first magnetic pole and an end of the second magnetic pole;

a protrusion formed on and at least partially surrounding the first magnetic pole; and a winding surrounding the first magnetic pole at the air gap and having a lead supported by the protrusion such that a clearance is formed between the winding and the first magnetic pole, wherein the protrusion is formed on a side of the first magnetic pole where the lead is positioned, and the protrusion is in contact with the lead.

2. The magnetic component according to claim 1, wherein the lead comprises a first portion not contacting the protrusion and a second portion contacting the protrusion, and an arrangement of the lead and protrusion satisfies the following relationship:

$$P1 \geq P/3,$$

wherein P represents a total width of the lead in the first direction, and P1 represents a width of the first portion.

3. The magnetic component according to claim 1, wherein the lead comprises a first portion not contacting the protrusion and a second portion contacting the protrusion, and a first clearance is formed between the lead and the first magnetic pole, and an arrangement of the lead and the first magnetic pole satisfies the following relationship:

$$S1 \geq P1/6,$$

wherein S1 represents a dimension of the first clearance in a third direction, P1 represents a width of the first portion, and wherein the third direction is perpendicular to a plane formed by the first and second directions.

4. The magnetic component according to claim 1, wherein the protrusion is provided at each side of the air gap.

5. The magnetic component according to claim 4, wherein in a cross section taken in a plane perpendicular to the first direction, a distance between the winding and an upper surface of the first magnetic pole in a third direction is represented by S3, a distance between the winding and a first side surface of the first magnetic pole in the second direction is represented by S2, and a distance between the winding and a second side surface of the first magnetic pole in the second direction is represented by S4, and at least one of the distances S2, S3 or S4 is greater than 0, and wherein the third direction is perpendicular to a plane formed by the first and second directions.

6. The magnetic component according to claim 5, wherein at least one of the distances S2, S3 or S4 is equal to or greater than P/6, where P is a total width of the lead in the first direction.

7. The magnetic component according to claim 1, wherein the first magnetic pole has a height in a third direction which is perpendicular to a plane formed by the first and second directions less than that of at least one of the second magnetic pole and the cover plate in the third direction.

8. The magnetic component according to claim 1, wherein the winding has a length in the second direction greater than that of the first magnetic pole in the second direction.

9. The magnetic component according to claim 1, wherein the winding has a height in a third direction which is perpendicular to a plane formed by the first and second directions greater than the height of the first magnetic pole in the third direction.

10. The magnetic component according to claim 1, wherein in a third direction which is perpendicular to a plane formed by the first and second directions, the first magnetic pole has a bottom surface higher than that of at least one of the cover plate and the second magnetic pole.

11. The magnetic component according to claim 10, wherein in the third direction, the protrusion has a bottom surface higher than that of at least one of the cover plate and the second magnetic pole.

12. The magnetic component according to claim 1, wherein in a third direction which is perpendicular to a plane formed by the first and second directions, the winding has an upper surface below or being at the same plane as that of at least one of the cover plate and the second magnetic pole.

13. The magnetic component according to claim 1, wherein the winding has stiffness sufficient to maintain its shape.

14. The magnetic component according to claim 1, wherein a size of the protrusion decreases downwardly in a third direction which is perpendicular to a plane formed by the first and second directions.

15. The magnetic component according to claim 1, wherein a non-magnetic material is interposed between the projection portion and the lead.

16. The magnetic component according to claim 1, wherein the protrusion is made from a non-magnetic material.

17. The magnetic component according to claim 1, wherein the projection portion and the first magnetic pole have a same material and are integrally formed.

18. The magnetic component according to claim 1, wherein the first magnetic pole has a section in a plane formed by the second direction and a third direction, wherein the section has a shape of ellipse, rounded rectangular, chamfered rectangular, rhombus, fusiform, or a combination thereof, and wherein the third direction is perpendicular to a plane formed by the first and second directions.

19. The magnetic component according to claim 1, wherein the projection portion is discontinuous in the second direction.

20. The magnetic component according to claim 1, wherein the magnetic component comprises a plurality of the first magnetic poles, and the magnetic component is a multi-phase integrated inductor.

21. The magnetic component according to claim 1, wherein the winding comprises a first lead and a second lead, and wherein the first and second leads are arranged below the first magnetic pole and the second magnetic pole, respectively.

22. The magnetic component according to claim 1, wherein the magnetic component is an inductor or a transformer.

* * * * *